US006381426B1

(12) United States Patent
Werner, Jr. et al.

(10) Patent No.: US 6,381,426 B1
(45) Date of Patent: Apr. 30, 2002

(54) AUTOMATIC GAIN CONTROL FOR ELECTROSTATIC VOLTMETERS

(75) Inventors: Alan J. Werner, Jr., Rochester; Michael D. Borton, Ontario; Mark A. Scheuer, Williamson, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/727,217

(22) Filed: Nov. 30, 2000

(51) Int. Cl.[7] ..... G03G 15/00

(52) U.S. Cl. ..... 399/73; 324/457; 399/48

(58) Field of Search ..... 399/48, 50, 73; 324/456, 454, 457

(56) References Cited

U.S. PATENT DOCUMENTS

| | | | | |
|---|---|---|---|---|
| 4,106,869 A | * | 8/1978 | Buchheit | 399/73 |
| 4,417,804 A | * | 11/1983 | Werner, Jr. | 399/73 |
| 5,243,292 A | | 9/1993 | Borton et al. | 324/458 |
| 5,950,040 A | | 9/1999 | Mestha et al. | 399/46 |

* cited by examiner

*Primary Examiner*—Arthur T. Grimley
*Assistant Examiner*—Hoang Ngo
(74) *Attorney, Agent, or Firm*—Perman & Green, LLP

(57) ABSTRACT

Method and apparatus for controlling amplifier gain, e.g., as used in ESV of a xerographic copier, has a light source, e.g., an LED, optically coupled to a gain control light dependent resistor (LDR). The LDR can be in a negative feedback loop around an amplifier. There is a voltage sensing probe located near the photoreceptor belt of the copier and coupled to an input of the amplifier.

14 Claims, 2 Drawing Sheets

AUTOMATIC GAIN CONTROL FOR ELECTROSTATIC VOLTMETERS

CROSS-REFERENCES TO RELATED APPLICATIONS

This application is related to Xerox docket No. 0740 (IP/A00102).

STATEMENT REGARDING FEDERALLY SPONSORED RESEARCH OR DEVELOPMENT

Not Applicable

BACKGROUND OF THE INVENTION

1. Field of the Invention

The present invention relates to gain control, and more particularly, to such control when used with ESVs (electrostatic voltmeters) in xerographic copying machines.

2. Description of the Related Art Including Information Disclosed Under 37 CFR 1.97 and 1.98

In xerographic copying machines it is desired to measure the potential on a photoreceptor to achieve better copy quality. This is done using an ESV. However, the standard "feedback" ESV is a second order feedback system. The "speed of response" of the ESV is dependent on the open loop gain of the system, which is dependent on both the spacing between a sense probe or head and the mechanical modulation (change in the spacing). In practice, there is an electronic gain control that is adjusted in the factory setup procedure to give the desired output response at the calibration spacing and the assumption is made that the amount of modulation stays constant. If the system gain is "high", the output will overshoot the final value. If it is "low", it will be slow or underdamped. If it is "optimized", it is "critically" damped, i.e., it is going as fast as possible without overshooting.

In the past, it has been assumed that the amount of gain remains constant. In fact, it is dependent on a stable modulating structure, such as the standard tuning fork and the newer ASIC (application specific integrated circuit) ESV "vibrating beam. Such structures can gave gains that vary with time, temperature, etc. Also, circuits in such structures can be floating at the high photoreceptor voltage, thereby making gain adjustment difficult.

It is therefore desirable to have an adjustable gain, even when the ESV is floating at a high voltage, in order to maintain optimum gain, and thus response speed.

BRIEF SUMMARY OF THE INVENTION

BRIEF DESCRIPTION OF THE SEVERAL VIEWS OF THE DRAWING(S)

DETAILED DESCRIPTION OF THE INVENTION

It will become evident from the following discussion that the present invention is equally well-suited for use in a wide variety of printing systems including ionographic printing machines and discharge area development systems, as well as other more general non-printing systems providing multiple or variable outputs such that the invention is not necessarily limited in its application to the particular system shown herein.

Figure 1:
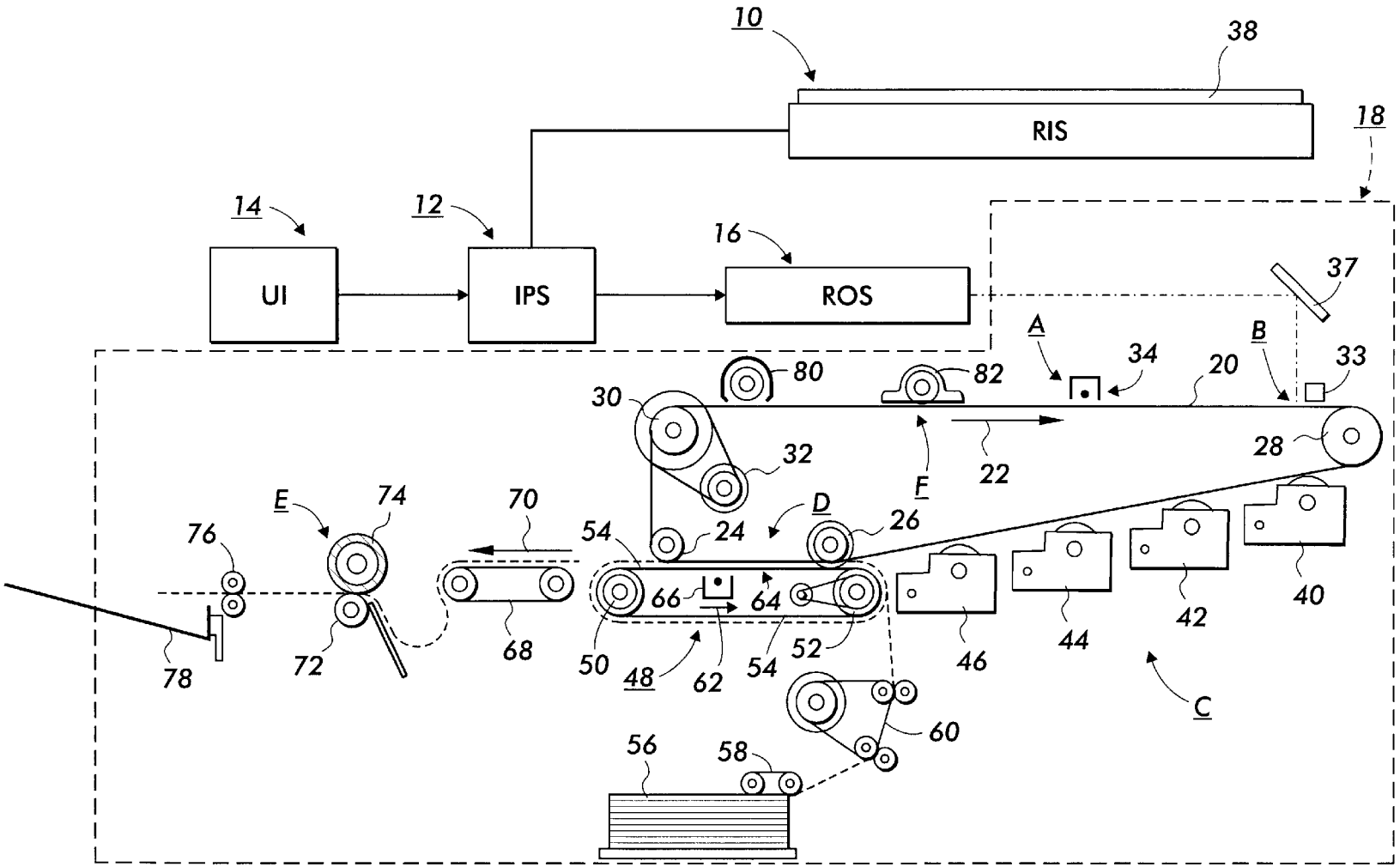
FIG. 1 is a general view of a copying apparatus.

Turning initially to FIG. 1, before describing the particular features of the present invention in detail, an exemplary electrophotographic copying apparatus will be described. The exemplary electrophotographic system may be a multicolor copier, as for example, the recently introduced Xerox Corporation "15775" copier. To initiate the copying process, a multicolor original document 38 is positioned on a raster input scanner (RIS), indicated generally by the reference numeral 10. The RIS 10 contains document illumination lamps, optics, a mechanical scanning drive, and a charge coupled device (CCD array) for capturing the entire image from original document 38. The RIS 10 converts the image to a series of raster scan lines and measures a set of primary color densities, i.e. red, green and blue densities, at each point of the original document. This information is transmitted as an electrical signal to an image processing system (IPS), indicated generally by the reference numeral 12, which converts the set of red, green and blue density signals to a set of calorimetric coordinates.

The IPS contains control electronics for preparing and managing the image data flow to a raster output scanner (ROS), indicated generally by the reference numeral 16. A user interface (UI), indicated generally by the reference numeral 14, is provided for communicating with IPS 12. UI 14 enables an operator to control the various operator adjustable functions whereby the operator actuates the appropriate input keys of UI 14 to adjust the parameters of the copy. UI 14 may be a touch screen, or any other suitable device for providing an operator interface with the system. The output signal from UI 14 is transmitted to IPS 12 which then transmits signals corresponding to the desired image to ROS 16.

ROS 16 includes a laser with rotating polygon mirror blocks. The ROS 16 illuminates, via mirror 37, a charged portion of a photoconductive belt 20 of a printer or marking engine, indicated generally by the reference numeral 18. Preferably, a multi-facet polygon mirror is used to illuminate the photoreceptor belt 20 at a rate of about 400 pixels per inch. The ROS 16 exposes the photoconductive belt 20 to record a set of three subtractive primary latent images thereon corresponding to the signals transmitted from IPS 12.

One latent image is to be developed with cyan developer material, another latent image is to be developed with magenta developer material, and the third latent image is to be developed with yellow developer material. These developed images are subsequently transferred to a copy sheet in superimposed registration with one another to form a multicolored image on the copy sheet which is then fused thereto to form a color copy. This process will be discussed in greater detail hereinbelow.

With continued reference to FIG. 1, marking engine 18 is an electrophotographic printing machine comprising photoconductive belt 20 which is entrained about transfer rollers 24 and 26, tensioning roller 28, and drive roller 30. Drive roller 30 is rotated by a motor or other suitable mechanism coupled to the drive roller 30 by suitable means such as a belt drive 32. As roller 30 rotates, it advances photoconductive belt 20 in the direction of arrow 22 to sequentially advance successive portions of the photoconductive belt 20 through the various processing stations disposed about the pth of movement thereof.

Initially, a portion of photoconductive belt 20 passes through a charging station, indicated generally by the reference letter A. At charging station A, a corona generating device 34 or other charging device generates a charge voltage to charge photoconductive belt 20 to a relatively high, substantially uniform voltage potential. The corona generator 34 comprises a corona generating electrode, a shield partially enclosing the electrode, and a grid disposed between the belt 20 and the unenclosed portion of the electrode. The electrode charges the photoconductive surface of the belt 20 via corona discharge. The voltage potential applied to the photoconductive surface of the belt 20 is varied by controlling the voltage potential of the wire grid.

Next, the charged photoconductive surface is rotated to an exposure station, indicated generally by the reference letter B. Exposure station B receives a modulated light beam corresponding to information derived by RIS 10 having a multicolored original document 38 positioned thereat. The modulated light beam impinges on the surface of photoconductive belt 20, selectively illuminating the charged surface of photoconductive belt 20 to form an electrostatic latent image thereon. The photoconductive belt 20 is exposed three times to record three latent images representing each color.

After the electrostatic latent images have been recorded on photoconductive belt 20, the belt is advanced toward a development station, indicated generally by the reference letter C. However, before reaching the development station C, the photoconductive belt 20 passes subjacent to a voltage monitor, preferably an electrostatic voltmeter 33, for measurement of the voltage potential at the surface of the photoconductive belt 20.

The electrostatic voltmeter 33 of the present invention provides the measuring condition in which charge is induced on a probe electrode corresponding to the sensed voltage level of the belt 20. The voltage potential measurement of the photoconductive belt 20 is utilized to determine specific parameters for maintaining a predetermined potential on the photoreceptor surface.

The development station C includes four individual developer units indicated by reference numerals 40, 42, 44, and 46. The developer units are of a type generally referred to in the art as "magnetic brush development units". Typically, a magnetic brush development system employs a magnetizable developer material including magnetic carrier granules having toner particles adhering triboelectrically thereto. The developer material is continually brought through a directional flux field to form a brush of developer material. The developer material is constantly moving so as to continually provide the brush with fresh developer material. Development is achieved by bringing the brush of developer material into contact with the photoconductive surface. Developer units 40, 42, and 44, respectively, apply toner particles of a specific color corresponding to the compliment of the specific color separated electrostatic latent image recorded on the photoconductive surface.

Each of the toner particle colors is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 20, while the green areas will be reduced to a voltage level ineffective for development. The charged areas are then made visible by having developer unit 40 apply green absorbing (magenta) toner particles onto the electrostatic latent image recorded on photoconductive belt 20. Similarly, a blue separation is developed by developer unit 42 with blue absorbing (yellow) toner particles, while the red separation is developed by developer unit 44 with red absorbing (cyan) toner particles.

Developer unit 46 contains black toner particles and may be used to develop the electrostatic latent image formed from a black and white original document. In FIG. 3, developer unit 40 is shown in the operative position with developer units 42, 44, and 46 being in the non-operative position.

After development, the toner image is moved to a transfer station, indicated generally by the reference letter D. Transfer station D includes a transfer zone, generally indicated by reference numeral 64, defining the position at which the toner image is transferred to a sheet of support material, which may be a sheet of plain paper or any other suitable support substrate. A sheet transport apparatus, indicated generally by the reference numeral 48, moves the sheet into contact with photoconductive belt 20. Sheet transport 48 has a belt 54 entrained about a pair of substantially cylindrical rollers 50 and 52. A friction retard feeder 58 advances the uppermost sheet from stack 56 onto a pre-transfer transport 60 for advancing a sheet to sheet transport 48 in synchronism with the movement thereof so that the leading edge of the sheet arrives at a preselected position, i.e. a loading zone. The sheet is received by the sheet transport 48 for movement therewith in a recirculating path. As belt 54 of transport 48 moves in the direction of arrow 62, the sheet is moved into contact with the photoconductive belt 20, in synchronism with the toner image developed thereon.

In transfer zone 64, a corona generating device 66 sprays ions onto the backside of the sheet so as to charge the sheet to the proper magnitude and polarity for attracting the toner image from photoconductive belt 20 thereto. The sheet remains secured to the sheet gripper so as to move in a recirculating path for three cycles. In this manner, three different color toner images are transferred to the sheet in superimposed registration with one another.

Each of the electrostatic latent images recorded on the photoconductive surface is developed with the appropriately colored toner and transferred, in superimposed registration with one another, to the sheet for forming the multi-color copy of the colored original document.

After the last transfer operation, the sheet transport system directs the sheet to a vacuum conveyor, indicated generally by the reference numeral 68. Vacuum conveyor 68 transports the sheet, in the direction of arrow 70, to a fusing station, indicated generally by the reference letter E, where the transferred toner image is permanently fused to the sheet. The fusing station includes a heated fuser roll 74 and a pressure roll 72. The sheet passes through the nip defined by fuser roll 74 and pressure roll 72. The toner image contacts fuser roll 74 so as to be affixed to the sheet. Thereafter, the sheet is advanced by a pair of rolls 76 to a catch tray 78 for subsequent removal therefrom by the machine operator. The last processing station in the direction of movement of belt 20, as indicated by arrow 22, is a cleaning station, indicated generally by the reference letter F.

A lamp 80 illuminates the surface of photoconductive belt 20 to remove any residual charge remaining thereon. Thereafter, a rotatably mounted fibrous brush 82 is positioned in the cleaning station and maintained in contact with photoconductive belt 20 to remove residual toner particles remaining from the transfer operation prior to the start of the next successive imaging cycle.

The foregoing description should be sufficient for purposes of the present application for patent to illustrate the general operation of an electrophotographic printing machine incorporating the features of the present invention. As described, an electrophotographic printing system may take the form of any of several well-known devices or systems. Variations of specific electrophotographic processing subsystems or processes may be expected without affecting the operation of the present invention.

Figure 2:
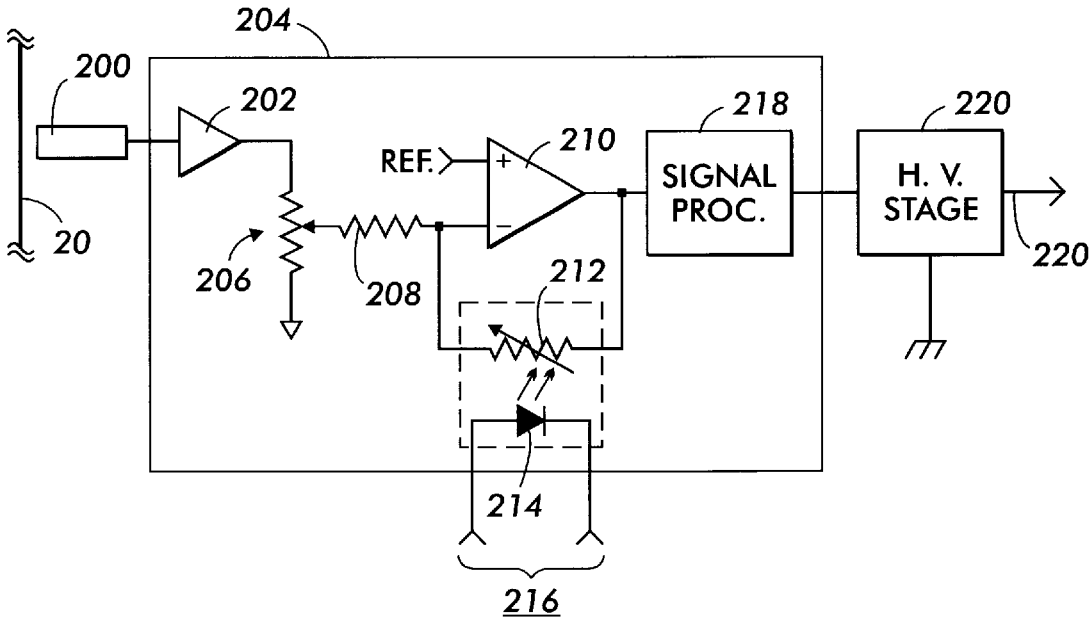
FIG. 2 is a schematic diagram of an ESV in accordance with the invention.

FIG. 2 is partially block and partially schematic diagram of ESV 33. An electrostatic probe or modulator 200 is disposed near belt 20 or any other surface to be measured. It applies a signal to preamplifier 202 of ESV circuit 204. As shown, ESV 204 is a standard ESV. However, an application specific integrated circuit (ASIC) can also be used. In turn, the output signal from preamplifier 202 is applied to potentiometer 206, which has a wiper connected to input resistor 208. The resistor 208 is connected to the inverting input of gain controlled amplifier 210 which has its non-inverting input coupled to a reference voltage source (not shown). Elements 208, 210, and 212 form a standard inverting gain stage. As known in the art, a non-inverting gain stage will also work as well. In the shown standard ESV elements 202, 206, 208 and 210 are all floating at the voltage being measured.

In accordance with the invention, it comprises a light dependent resistor (LDR) 212 and a light source, e.g., a light emitting diode (LED), 214, optically coupled to LDR 212 and electrically coupled to an external control system as shown by leads 216. It will be appreciated that by varying the current through LED 214, the resistance of LDR 212 can be controlled. In turn, this controls the negative feedback around the amplifier 210 and hence its gain.

It will be appreciated that any of resistors 206, 208, and 212 can comprise an LDR and a fixed resistor either in series or parallel with the LDR.

The output signal from gain control amplifier 210 is applied to signal processor 218, which normally comprises a demodulator and integrator as known in the art.

A grounded high voltage level shifting stage 220 provides an output signal at a relatively low voltage at output terminal 220. From terminal 220 it is applied to a system (not shown) for controlling the voltage on belt 20 as known in the art.

It should be determined what the response of the ESV 204 is to "step" input. There are two approaches to this. The ASIC ESV has a built in "min/max" function so the "max-"signal is always present; thus any overshoot is always being measured by comparing the "max" to the "normal"output signals for a step signal on the belt 20 long enough to find the "settled" value. Thus critically damped performance can be found either by starting high and decreasing the gain until there is no overshoot or starting low and increasing the gain until overshoot just appears. The second approach is to an external measuring system (not shown) to do the same thing. Modern data collection in the machines is quite capable of doing this.

Given AGC, the ESV can be optimized to any machine process speed and test patch configuration. It will be appreciated that the standard ESV 204 has the signal processing circuit 218 floating at the voltage being measured. Therefore, any system to control the gain must be electrically isolated input to output, which the LED/LDR does. The ASIC ESV has all signal processing circuits at ground potential so this is not a problem. However, the LED/LDR is still the best candidate in that its input/output DC isolation coupled with its output being a simple resistor allows the "output element" to connect anywhere in either circuit, particularly with respect to other circuit elements and ground.

While the present invention has been particularly described with respect to preferred embodiments, it will be understood that the invention is not limited to these particular preferred embodiments, the process steps, the sequence, or the final structures depicted in the drawings. On the contrary, it is intended to cover all alternatives, modifications, and equivalents as may be included within the spirit and scope of the invention defined by the appended claims. In addition, other methods and/or devices may be employed in the method and apparatus of the instant invention as claimed with similar results.

What is claimed is:

1. A method for controlling gain, said method comprising:

providing negative feedback using a gain control light dependent resistor;

applying a gain control signal to a light source; and controlling response speed by applying the light emitted by said source to said gain control light dependent resistor.

2. The method of claim 1, further comprising receiving an input signal.

3. The method of claim 1, further comprising supplying an output signal.

4. Apparatus comprising:

a gain control circuit having a light dependent gain control resistor;

a light source optically coupled to said resistor and receiving a gain control signal; and means for controlling response speed including said gain control circuit comprising an amplifier, and said resistor is coupled in a negative feedback loop around said amplifier.

5. The apparatus of claim 4, wherein said gain control circuit further comprises a signal input.

6. The apparatus of claim 5, further comprising a voltage measuring probe disposed proximate a photoreceptor belt of a xerographic copier.

7. The apparatus of claim 5, further comprising a pre-amplifier coupled to said signal input.

8. The apparatus of claim 4, wherein said gain control circuit further comprises a signal processor.

9. The apparatus of claim 4, wherein said light source comprises a light emitting diode.

10. A xerographic printer apparatus comprising:

a photoreceptor belt;

a voltage measuring probe;

a gain control circuit coupled to said probe having a light dependent gain control resistor;

a light source optically coupled to said resistor and receiving a gain control signal; and means for controlling response speed including said gain control circuit comprising an amplifier, and said resistor is coupled in a negative feedback loop around the amplifier.

11. The apparatus of claim 10, wherein said gain control circuit further comprises a signal input.

12. The apparatus of claim 11, further comprising a pre-amplifier coupled to said signal input.

13. The apparatus of claim 10, wherein said gain control circuit further comprises a signal processor.

14. The apparatus of claim 10, wherein said light source comprises a light emitting diode.

* * * * *